US006371679B1

(12) United States Patent
Peleman

(10) Patent No.: US 6,371,679 B1
(45) Date of Patent: Apr. 16, 2002

(54) FILE FOLDER

(75) Inventor: Guido Peleman, Antwerp (BE)

(73) Assignee: Unibind (Cyprus) Limited, Nicosia (CY)

( * ) Notice: Subject to any disclaimer, the term of this patent is extended or adjusted under 35 U.S.C. 154(b) by 0 days.

(21) Appl. No.: 09/737,503

(22) Filed: Dec. 18, 2000

(51) Int. Cl.[7] ..... B42F 13/00

(52) U.S. Cl. ..... 402/73; 402/70; 281/29; 281/37; 281/45

(58) Field of Search ..... 402/70, 73, 80 R; 281/29, 31, 37, 45, 51

(56) References Cited

U.S. PATENT DOCUMENTS

| | | | | |
|---|---|---|---|---|
| 5,738,460 A | * | 4/1998 | Flynn | 402/73 |
| 5,741,028 A | * | 4/1998 | Hatano et al. | 402/73 X |
| 6,213,670 B1 | * | 4/2001 | Wien | 402/73 |
| 6,250,834 B1 | * | 6/2001 | Wien | 402/73 |

* cited by examiner

*Primary Examiner*—Willmon Fridie, Jr.
(74) *Attorney, Agent, or Firm*—Bacon & Thomas, PLLC

(57) ABSTRACT

A file folder. The file folder includes at least two parts. A first part (2) is provided with binder rings (4) and a second part (3) that defines a receiving chamber of fixed dimensions that can contain bundles of loose documents or periodicals and the like.

9 Claims, 3 Drawing Sheets

FILE FOLDER

BACKGROUND OF THE INVENTION

1. Field of the Invention

The present invention relates to a file folder, more particularly to a ringbinder which has a little container that may be used to contain sheets, bundles of sheets, loose documents such as loose or bound elements, etc.

2. Description of the Related Art

It is known that loose sheets of paper may be kept together by providing them with perforations and by classifying them in a file folder having binder rings.

Also, it is often necessary to classify a limited number of documents, such as loose or bound elements together with the sheets of paper in a same file. As often such periodicals are not suitable to be provided with perforations, it is difficult to classify them in a classical file folder having binder rings.

To overcome this problem, some file folders have been proposed which have pockets at one or both of the inner faces. Such pockets, however, have a number of drawbacks. For instance, documents can drop out easily. Also, these pockets are often made of transparant material, which isn't discreet either. Moreover, such pockets show the disadvantage that they can contain only a very limited number of sheets, and mostly are not suitable for classifying loose or bound elements and the like.

SUMMARY OF THE INVENTION

The present invention aims therefore at providing an improved file folder which does not show said disadvantages. To this end, the file folder according to the invention comprises at least two parts, respectively a first part provided with binder rings and a second part defining a receiving chamber of fixed dimensions that can contain bundles of loose documents or loose or bound elements and the like.

In a preferred embodiment, the first part forms a main compartment, whereas the second part forms an auxiliary compartment, such that the thickness of the receiving space available in the first part is larger than the thickness of the receiving space available in the second part. In a large number of applications, the number of documents which are not suitable to be perforated and to be attached by means of binder rings is smaller than the number of documents to be held and stored by means of the binder rings, so that in these applications this embodiment is very advantageous.

In the most preferred embodiment the file folder further at least comprises a first sheet made of a rigid material, a second sheet made of a rigid material, a back section flexibly connecting said first sheet and said second sheet to each other, wherein said second part is defined, on the one hand, by said second sheet and, on the other hand, an inwardly directed flap made of a rigid material connected to the second sheet, this flap being spaced at a well defined distance from this sheet by means of connecting side pieces. In such case, the first part is preferably formed by the receiving space between the first sheet and said flap.

According to the most preferred embodiment, the binder rings are attached to said flap, more particularly in the proximity of the free edge of this flap.

BRIEF DESCRIPTION OF THE DRAWINGS

In order to better show the characteristics of the invention, some preferred embodiments according to the present invention are described hereafter, as an example and without any restrictive character whatsoever, reference being made to the accompanying drawings, in which.

DETAILED DESCRIPTION OF THE PREFERRED EMBODIMENT

Figure 1:
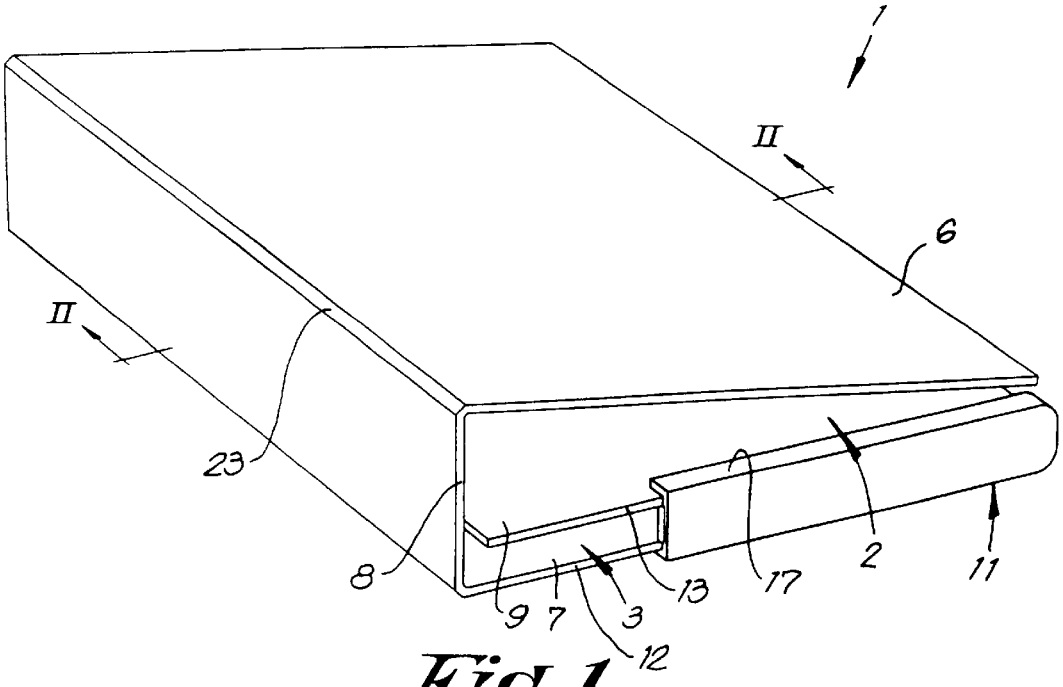
FIG. 1 represents a perspective view of a file folder according to the invention.
Figure 3:
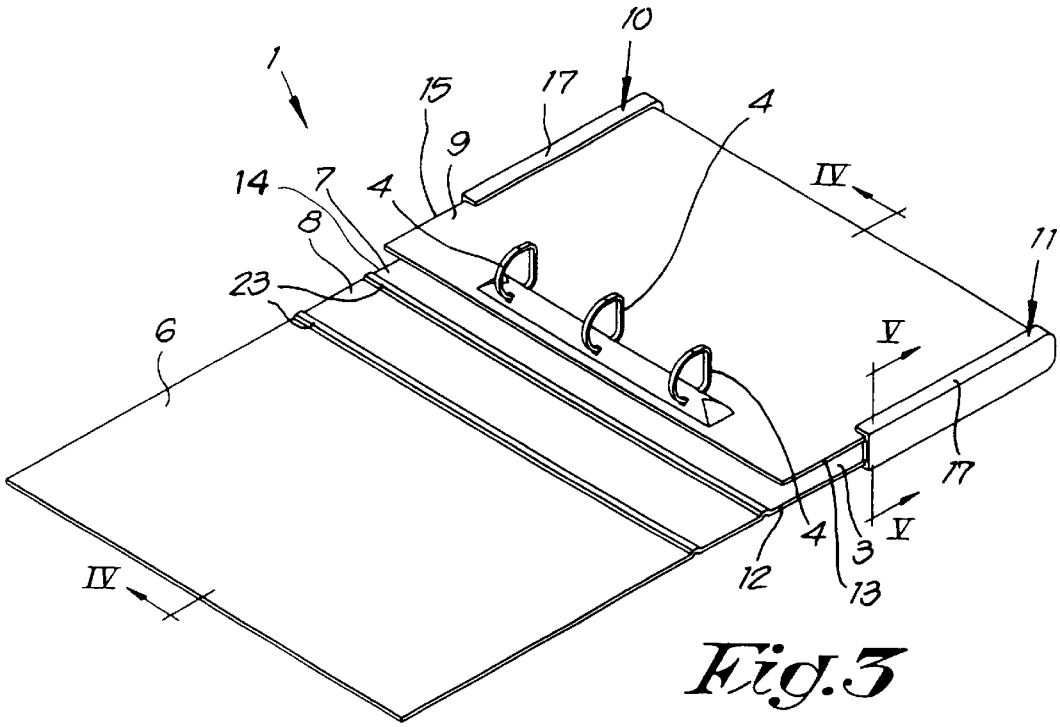
FIG. 3 represents the file folder of FIG. 1 in opened condition.

As represented in FIGS. 1 to 4, the file folder 1 according to the invention comprises two parts 2–3, respectively a first part 2 provided with binder rings 4 and a second part 3 defining a receiving chamber of fixed dimensions that can contain bundles 5 of loose documents or periodicals and the like, or even objects of a complete other nature.

Figure 2:
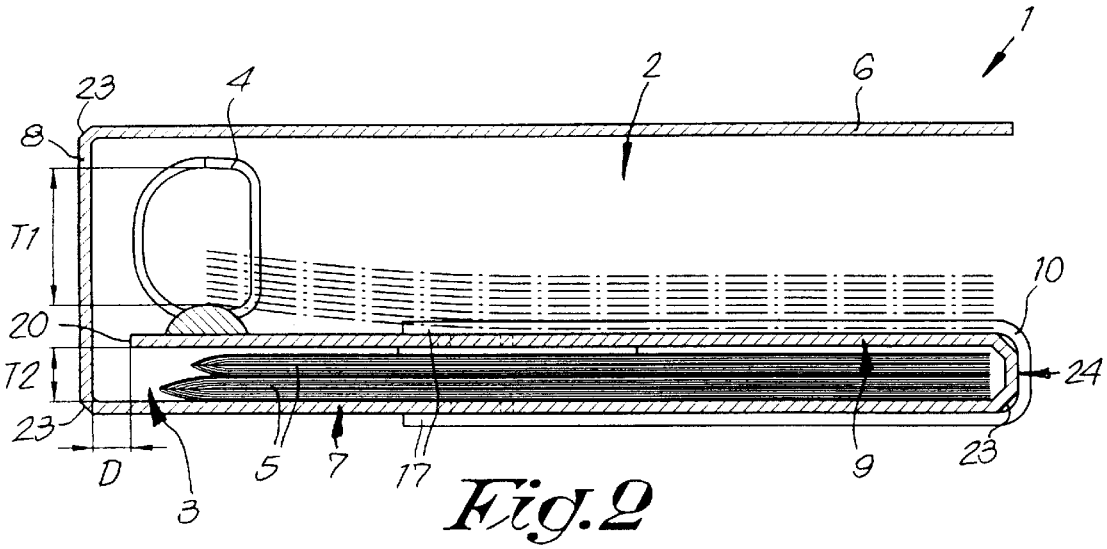
FIG. 2 represents a cross-sectional view according to line II—II in FIG. 1, whereby documents are classified in the file folder.
Figure 4:
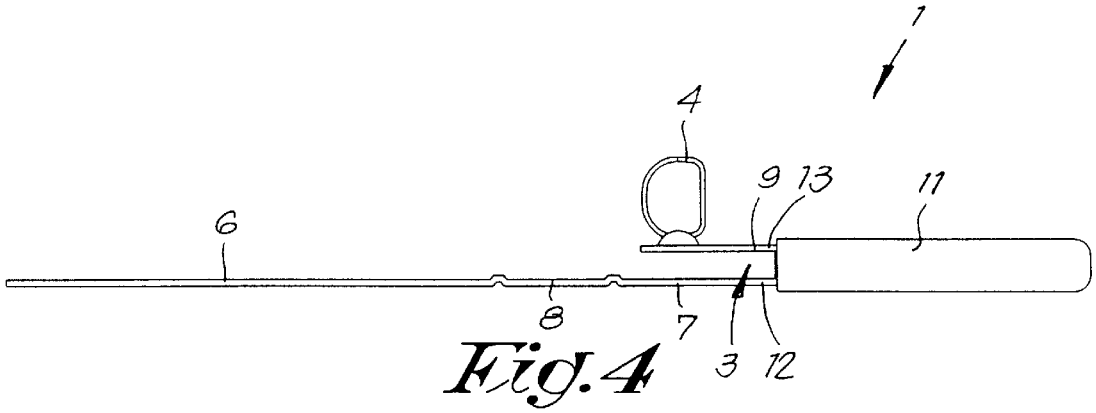
FIGS. 4 and 5 represent cross-sectional views, according to lines IV—IV and V—V, respectively in FIG. 3.

As represented in the embodiment of FIGS. 1 to 4, and more particularly indicated in FIG. 2, it is preferred that the first part 2 forms a main compartment, whereas the second part 3 forms an auxiliary compartment, such as the thickness T1 of the receiving space available in the first part 2 is larger than the thickness T2 of the receiving space available in the second part 3. More particularly, the thickness T1 of the first part 2 is about two times the thickness T2 of the second part 3.

As represented in the figures, the file folder 1 is composed of a first sheet 6 made of a rigid material, a second sheet 7 made of a rigid material, a back section 8 flexibly connecting said first sheet 6 and said second sheet 7 to each other, and an inwardly directed flap 9 made of a rigid material connected to the second sheet 7, this flap 9 being spaced at a well defined distance from this sheet 7. Hereby, said first part 2 is formed by the portion between the first sheet 6 and the flap 9, whereas the second part 3 is formed by the portion between the second sheet 7 and the flap 9.

Figure 5:
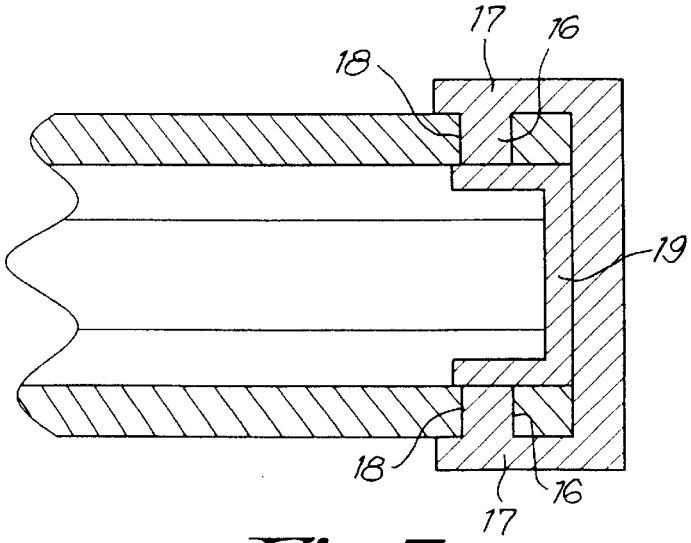

The flap 9 is spaced from the second sheet 7 by means of connecting side pieces 10–11 between the lower edges 12–13 and upper edges 14–15 of the flap 9 and said second sheet 7. The connecting side pieces 10–11 may be connected to said edges 12 to 15 in any suitable manner. However, it is preferred to use mechanical connections, for example as described in the American U.S. Pat. No. 5,931,373, whereby the connections are realized by means of tenons 16 provided at flanges 17 of the side pieces 10–11, which in mounted condition co-operate with openings 18 in the second sheet 7 and in the flap 9. Further, as represented in the cross-sectional view of FIG. 5, there may also be provided a locking element 19 which can be located against the inner side of the connecting side pieces 10–11, to avoid that the second sheet 7 and/or flap 9 become disconnected from these connecting side pieces 10–11.

In the most preferred embodiment, the free edge of the flap 9 in the closed condition of the file folder 1 is located at a distance D from the back section 8, which is smaller than one centimeter. This offers the advantage that it is difficult for the bundles 5 to leave the receiving space of the second part 3 when placing the file folder 1 upright in close condition.

As represented in the embodiment of FIGS. 1 to 4, the binder rings 4 are preferably mounted on the flap 9, more particularly attached to this flap 9 in the proximity of the free edge 20 of the latter. Of course, other configurations are possible.

Figure 6:
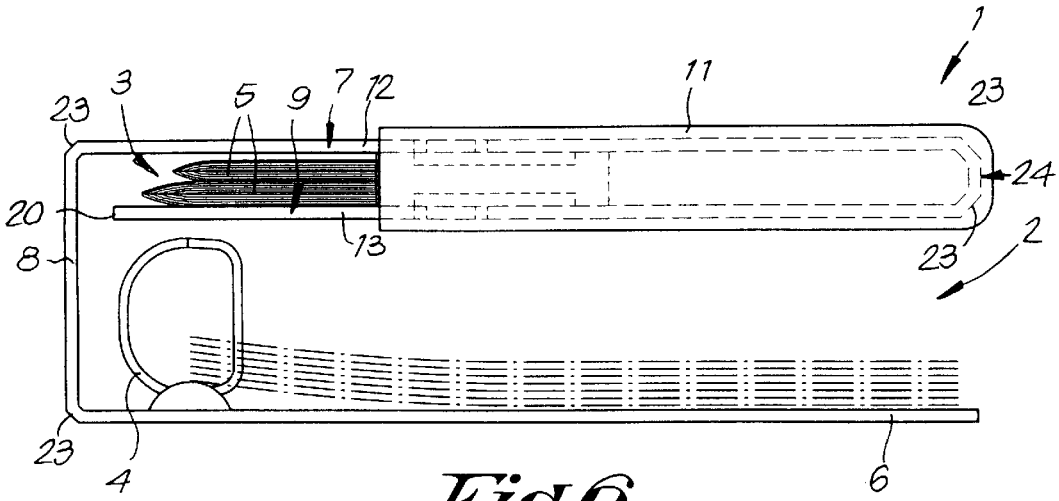
FIGS. 6 and 7 represent file folders according to two alternate embodiments of the invention.

In an alternate embodiment, represented in FIG. 6, said binder rings 4 are attached to said first sheet 6 in the proximity of said back section 8. According to another, non-represented embodiment, the binder rings 4 may also be attached to the back section 8 itself.

Figure 7:
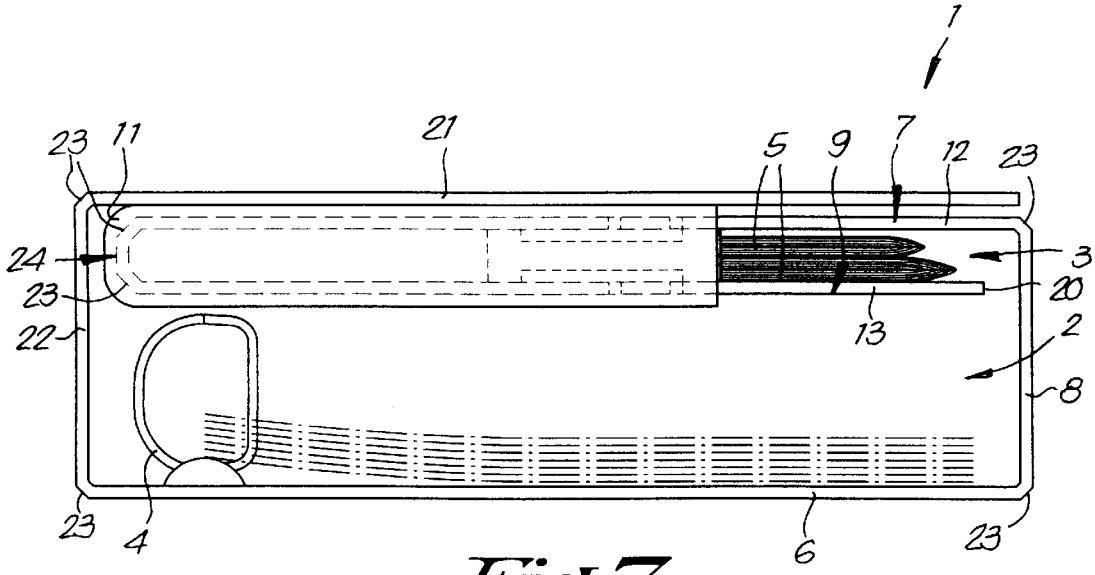

FIG. 7 represents a further variant in which an additional sheet 21 is connected to the first sheet 6 by means of a second back section 22, which is located opposite to the previously mentioned back section 8. As shown in this variant, the binder rings 4 may also be located hereby the second back section 22. It is clear that still other configurations of a first part 2 with a second part 3 are possible without leaving the scope of the invention. Moreover, according to the invention, it is not excluded to provide the file folder 1 with two parts 3 for receiving bundles of loose papers, leaflets, periodicals and the like. For example, in the embodiment of FIGS. 1 to 4, instead of only providing a second part 3 at the second sheet 7, there may also be provided a further part, similar to the second part 3, at the first sheet 6.

First sheet 6, second sheet 7, back section 8 and flap 9 are preferably manufactured from a type of thick cardboard and may be provided by a covering, such as a smooth foil which is bonded to the cardboard. A number of fold lines 23 may be provided at the spot of back section 8 and at the spot of a fold panel 24 connecting the second sheet 7 and the flap 9.

The present invention is in no way limited to the embodiments described above and represented in the drawings, but such a file folder may be realized in different shapes and dimensions, without departure from the scope of invention.

What is claimed is:

1. A file folder, comprising at least two parts, respectively a first part provided with binder rings and a second part defining a receiving chamber of fixed dimensions that can contain bundles of loose documents, bound documents or periodicals and the like;

wherein the first part forms a main compartment, whereas the second part forms an auxiliary compartment, such that the thickness of the receiving space available in the first part is larger than the thickness of the receiving space available in the second part; and wherein this file folder further at least comprises a first sheet made of a rigid material, a second sheet made of a rigid material, a back section flexibly connecting said first sheet and said second sheet to each other, and wherein said second part is defined by said second sheet and an inwardly directed flap made of a rigid material connected to the second sheet, this flap being spaced at a well defined distance from this sheet.

2. The file folder as claimed in claim 1, wherein the flap and said sheets include lower edges and upper edges and wherein said flap is spaced at a well defined distance from the second sheet by means of connecting side pieces provided between the lower edges and upper edges of the flap and said second sheet.

3. The file folder as claimed in claim 2, wherein said connecting side pieces are connected to said edges by means of mechanical connections.

4. The file folder as claimed in claim 1, wherein said second part is formed by a receiving space between said first sheet and said flap.

5. The file folder as claimed in claim 4, wherein said binder rings are attached to said flap.

6. The file folder as claimed in claim 5, wherein said binder rings are attached to said flap in the proximity of the free edge of this flap.

7. The file folder as claimed in claim 6, wherein said binder rings are attached to said first sheet in the proximity of said back section and are attached to the back section.

8. The file folder as claimed in claim 4, wherein the free edge of the flap in the closed condition of the file folder is located at a distance from the back section, which is smaller than one centimeter.

9. The file folder as claimed in claim 4, wherein said binder rings are attached to the back section.

* * * * *